US009008534B2

(12) United States Patent
Yuasa

(10) Patent No.: US 9,008,534 B2
(45) Date of Patent: Apr. 14, 2015

(54) ROTOR SUPPORT MECHANISM AND IMAGE FORMATION APPARATUS

(75) Inventor: Hiroshi Yuasa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 118 days.

(21) Appl. No.: 13/339,665

(22) Filed: Dec. 29, 2011

(65) Prior Publication Data

US 2012/0181414 A1 Jul. 19, 2012

(30) Foreign Application Priority Data

Jan. 13, 2011 (JP) ..... 2011-004895

(51) Int. Cl.
*G03G 21/20* (2006.01)

(52) U.S. Cl.
CPC ..... *G03G 21/206* (2013.01); *G03G 2221/1645* (2013.01)

(58) Field of Classification Search
CPC ..... G03G 15/2017; G03G 21/206; G03G 2221/1645
USPC ..... 399/92
See application file for complete search history.

(56) References Cited

U.S. PATENT DOCUMENTS 4,353,680 A * 10/1982 Hiraoka et al.
5,269,598 A * 12/1993 Liu
5,448,495 A * 9/1995 Liu
5,510,827 A * 4/1996 Kubota et al.
5,559,581 A * 9/1996 Sugiura et al.
5,561,496 A * 10/1996 Sugiura et al. ..... 399/107
5,634,178 A * 5/1997 Sugiura et al.
5,713,790 A * 2/1998 Lin
6,031,719 A * 2/2000 Schmitt et al.
6,040,981 A * 3/2000 Schmitt et al.
6,183,214 B1 * 2/2001 Ko
6,215,659 B1 * 4/2001 Chen
6,343,011 B1 * 1/2002 Yu
6,826,048 B1 * 11/2004 Dean et al.
7,385,813 B2 * 6/2008 Lin
7,500,827 B2 * 3/2009 Mizuguchi
7,830,662 B2 * 11/2010 Yeh et al.
2002/0054770 A1 * 5/2002 Kimizuka ..... 399/92
2003/0137806 A1 * 7/2003 Cannon ..... 361/695

FOREIGN PATENT DOCUMENTS

JP H06-317959 A 11/1994
JP 2000-172031 A 6/2000
JP 2005273589 A * 10/2005
JP 2008082250 A * 4/2008
JP 2008-281632 A 11/2008

* cited by examiner

*Primary Examiner* — Walter L Lindsay, Jr.
*Assistant Examiner* — Milton Gonzalez
(74) *Attorney, Agent, or Firm* — Marvin A. Motsenbocker; Mots Law, PLLC

(57) ABSTRACT

A rotor support structure includes: an operable unit including a rotor and a casing rotatably supporting the rotor; a support member includes a support member main body configured to accommodate therein the operable unit, and an attachment part to attach the support member main body to a base; and a press part configured, when the support member with the operable unit accommodated therein is attached to the base, to press the operable unit to hold the operable unit in the support member main body.

22 Claims, 16 Drawing Sheets

ROTOR SUPPORT MECHANISM AND IMAGE FORMATION APPARATUS

CROSS REFERENCE TO RELATED APPLICATIONS

This application claims priority based on 35 U.S.C. 119 from prior Japanese Patent Application No. 2011-004895 filed on Jan. 13, 2011, entitled "ROTOR SUPPORT MECHANISM AND IMAGE FORMATION APPARATUS", the entire contents of which are incorporated herein by reference.

BACKGROUND OF THE INVENTION

1. Field of the Invention

The invention relates to a rotor support mechanism and an image formation apparatus.

2. Description of Related Art

A conventional image forming apparatus, such as a printer, a copy machine, a facsimile machine, and a multi function peripheral/printer (MFP), operates as follows. A charge roller uniformly charges a surface of a photosensitive drum, a LED head exposes light onto the uniformly charged surface of the photosensitive drum thereby forming an electrostatic latent image thereon, a development device supplies toner to the electrostatic latent image thereby forming (developing) a toner image on the surface of the photosensitive drum, a transfer roller transfers the toner image onto a paper sheet, and then a fixation unit fixes the toner image to the paper sheet, thereby forming an image on the paper sheet.

The fixation unit includes a fixation roller having therein a heater and a pressure roller pressed against the fixation roller. When the paper sheet is conveyed between the fixation roller and the pressure roller, the fixation roller heats the toner image on the paper sheet and the pressure roller presses the paper sheet against the fixation roller, thereby fixing the toner image onto the paper sheet.

Since the fixation roller includes the heater therein, the inside temperature of the printer tends to be high due to the heat generated by the heater.

To prevent the inside temperature from becoming too high, the printer includes a ventilation fan having a rotor to discharge the air inside the printer to the outside thereof (See, for example, Japanese Patent Application Laid-Open No. 2000-172031).

SUMMARY OF THE INVENTION

However, since the fan is fixed to the housing by means of screws in the conventional printer, the operation of attaching and detaching the fan may be troublesome.

An object of an embodiment of the invention is to simplify the operation of attachment and detachment of an operable unit having a rotor to a base.

An aspect of the invention is a rotor support mechanism that includes: an operable unit including a rotor and a casing rotatably supporting the rotor; a support member that includes a support member main body configured to accommodate therein the operable unit and an attachment part to attach the support member main body to a base; and a press part configured, when the support member with the operable unit accommodated therein is attached to the base, to press the operable unit to hold the operable unit in the support member main body.

According to this aspect, the workability of attaching and detaching the operable unit can be improved.

DETAILED DESCRIPTION OF EMBODIMENTS

Figure 1:
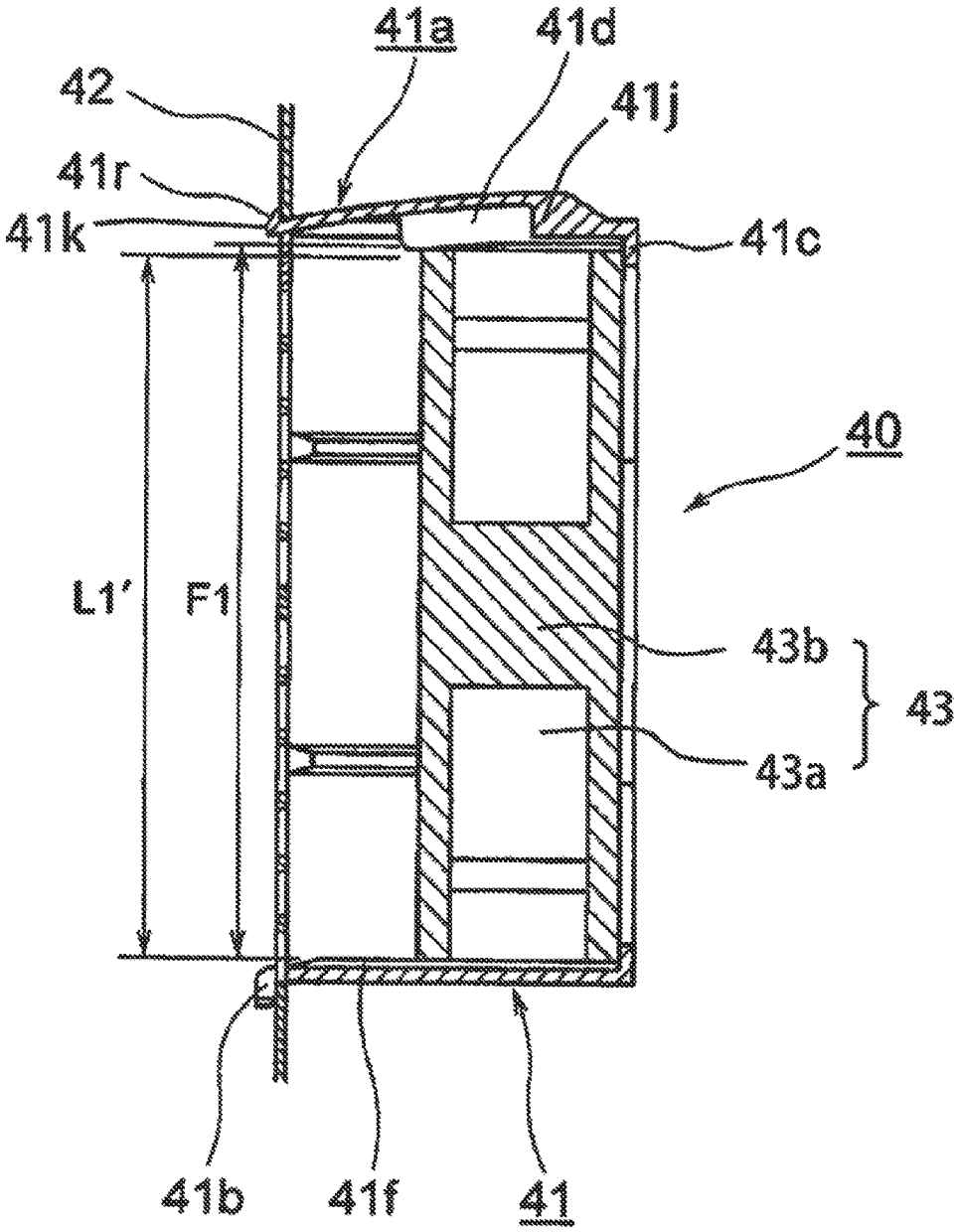
FIG. 1 is a sectional view of a rotor support mechanism according to a first embodiment of the invention, illustrating a state where a fan unit is attached.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Descriptions of the following embodiments are given for a printer as an image formation apparatus.

Figure 2:
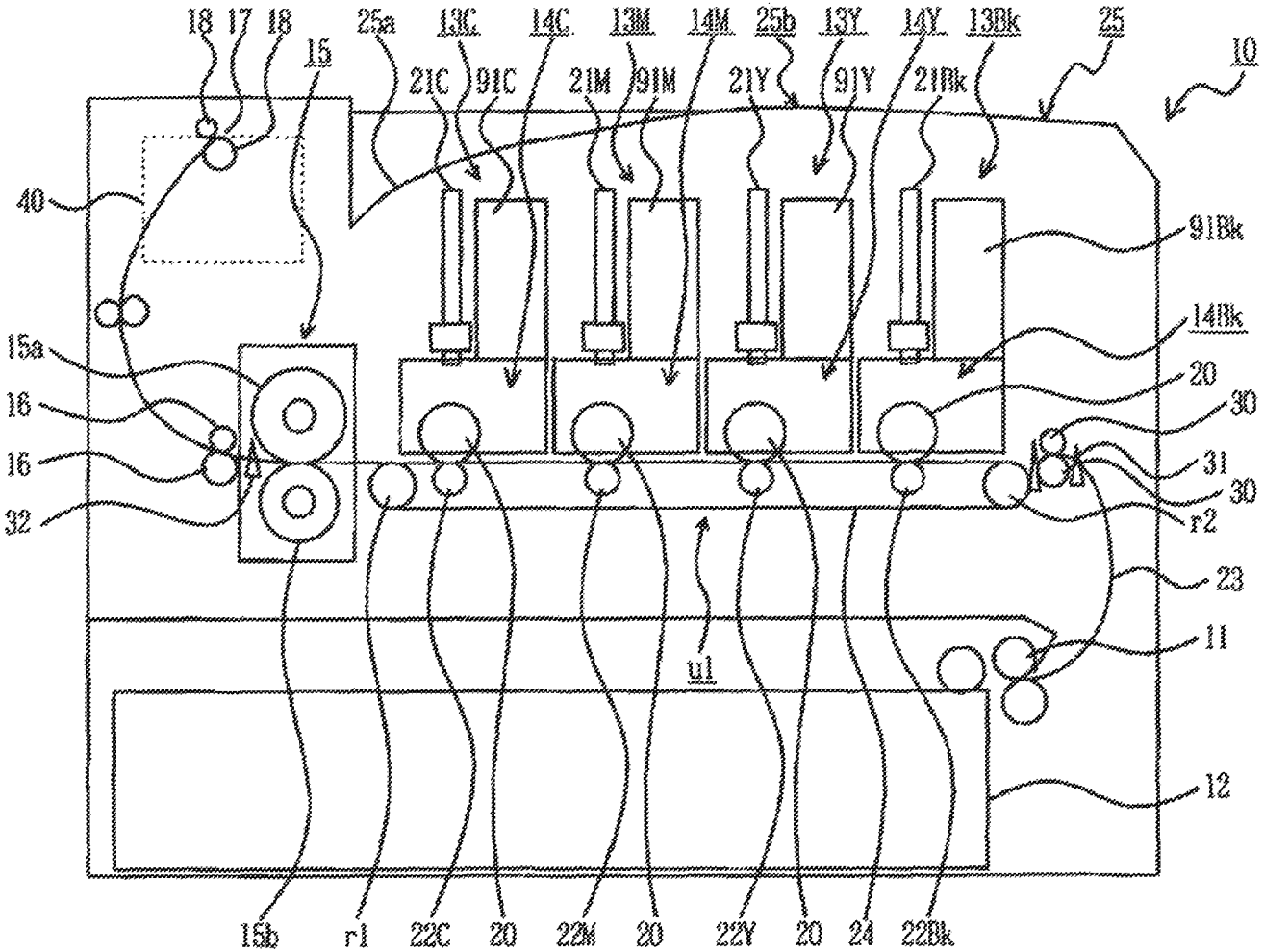
FIG. 2 is a conceptual diagram of a printer according to the first embodiment of the invention.

FIG. 2 is a conceptual diagram of a printer of the first embodiment of the invention.

In FIG. 2, reference numeral 10 designates the printer (the image formation apparatus). Reference numeral 11 designates a sheet feed roller, serving as a medium feeder, to be rotated by a feed motor or a feed driver to feed sheets (not shown) serving as media. Reference numeral 12 designates a sheet cassette to accommodate therein sheets being stacked, and reference numeral 23 designates a conveyance path in which the sheet is to be conveyed. Reference numerals 13Bk, 13Y, 13M, and 13C designate image formation units for black, yellow, magenta, and cyan, respectively, and reference numeral 25 designates a housing of image formation apparatus 10.

Image formation units 13Bk, 13Y, 13M, and 13C include image formation unit main parts 14Bk, 14Y, 14M, and 14C which are main parts of image formation units 13Bk, 13Y, 13M, and 13C and toner cartridges 91Bk, 91Y, 91M, and 91C, serving as developer containers, detachably attached to image formation unit main parts 14Bk, 14Y, 14M, and 14C.

Each image formation unit main part 14Bk, 14Y, 14M, 14C includes: photosensitive drum 20 serving as an image carrier; a charge roller (not shown) serving as a charge device configured to uniformly charge the surface of photosensitive drum 20; a development roller (not shown) serving as a developer carrier configured to attach toner to a latent image (an electrostatic latent image) formed on the surface of photosensitive drum 20 thereby forming a toner image serving as a developer image; and a toner supply roller (not shown) serving as a developer supply member configured to supply the toner to the development roller. Note that the development roller, the toner supply roller, and the like make up a development unit or a development device.

LED heads 21Bk, 21Y, 21M, and 21C, serving as an exposure device, are provided opposite to respective photosensitive drums 20 so as to emit light to the surface of each respective photosensitive drum 20 and thereby form an electrostatic latent image on the surface of each photosensitive drum 20.

In image formation units 13Bk, 13Y, 13M, and 13C, the charge rollers uniformly charge the surfaces of photosensitive drums 20, LED heads 21Bk, 21Y, 21M, and 21C emit light to the uniformly charged surfaces of photosensitive drums 20 thereby forming electrostatic latent images on photosensitive drums 20, and then the development rollers supply toner of respective colors to the electrostatic latent images thereby forming (developing) toner images of respective colors.

Image transfer unit u1 is provided below image formation units 13Bk, 13Y, 13M, and 13C. Image transfer unit ul includes: drive roller r1 serving as a first roller; driven roller r2 serving as a second roller; conveyance belt 24 serving as a conveyance member, tensely stretched between drive roller r1 and driven roller r2; and transfer rollers 22Bk, 22Y, 22M, and 22C, serving as an image transferor, provided opposite to photosensitive drums 20 such that the upper line of conveyance belt 24 is positioned between photosensitive drums 20 and transfer rollers 22Bk, 22Y, 22M, and 22C. Rotation of drive roller r1, driven by an unillustrated conveyance driver, makes conveyance belt 24 operate in a rotating manner.

Resist roller pair 30, serving as a print timing adjuster, is provided adjacent to, and upstream from, image formation unit 13Bk in the medium conveyance direction. Medium detector 31 detects if a medium has been conveyed to resist roller pair 30. Resist roller pair 30 conveys the medium downstream to be synchronized with the timing of the image formation by image formation units 13Bk, 13Y, 13M, and 13C.

Fixation unit 15, serving as a fixation device or a fuser, is provided downstream from image formation unit 13C in the medium conveyance direction. Fixation unit 15 includes: heat roller 15*a* serving as a first roller and having therein a heater or heating element (not shown) ; and press roller 15*b* serving as a second roller. Medium detector 32 is provided to detect if the medium has been passed through fixation unit 15.

Discharge roller pairs 16 and 18 are provided downstream from fixation unit 15 in the medium conveyance direction. Medium outlet 17 or a medium discharge port is formed adjacent to discharge roller pair 18. Stacker 25*a* is formed at upper cover 25*b*, on which the media that are discharged from medium outlet 17 are to be stacked.

Since fixation unit 15, as a heat source, is provided in housing 25 of image formation apparatus 10, the inside temperature of image formation apparatus 10 tends to be high due to the heat generated by fixation unit 15. If the temperature inside image formation apparatus 10 becomes too high, image formation units 13Bk, 13Y, 13M, and 13C are affected by the high temperature, which may cause degradation of the image quality. To prevent this, the embodiment attaches fan unit 40, serving as a air-exhauster or a ventilation device, to housing 25 in the vicinity of medium outlet 17, so that fan unit 40 can discharge air from the inside to the outside of image formation apparatus 10, thereby preventing the temperature inside image formation apparatus 10 from becoming too high.

Next, operation of the printer having the above configuration will be described.

First, sheets stacked in sheet cassette 12 are fed, by sheet feed roller 11, one by one, toward image formation units 13Bk, 13Y, 13M, and 13C. When medium detector 31 detects that the sheet has reached resist roller pair 30, resist roller pair 30 conveys the sheet in the downstream direction to be synchronized with the timing of forming images by image formation units 13Bk, 13Y, 13M, and 13C.

Next, the sheet is conveyed between photosensitive drums 20 and transfer rollers 22Bk, 22Y, 22M, and 22C, while toner images of respective colors formed on photosensitive drums 20 are sequentially superimposed on the sheet by means of transfer rollers 22Bk, 22Y, 22M, and 22C, thereby forming a multi-color toner image on the sheet.

The sheet having the multi-color toner image is then conveyed to fixation unit 15. In fixation unit 15, the toner image is heated by heat roller 15*a* and pressed by press roller 15*b*, thereby fixing the multi-color toner image to the sheet, that is, forming a multi-color image on the sheet.

The sheet that is discharged from fixation unit 15 is detected by medium detector 32 and is conveyed by discharge roller pairs 16 and 18. The sheet is then discharged from medium outlet 17 so as to be stacked in stacker 25*a*.

Next, fan unit 40 will be described.

Figure 3:
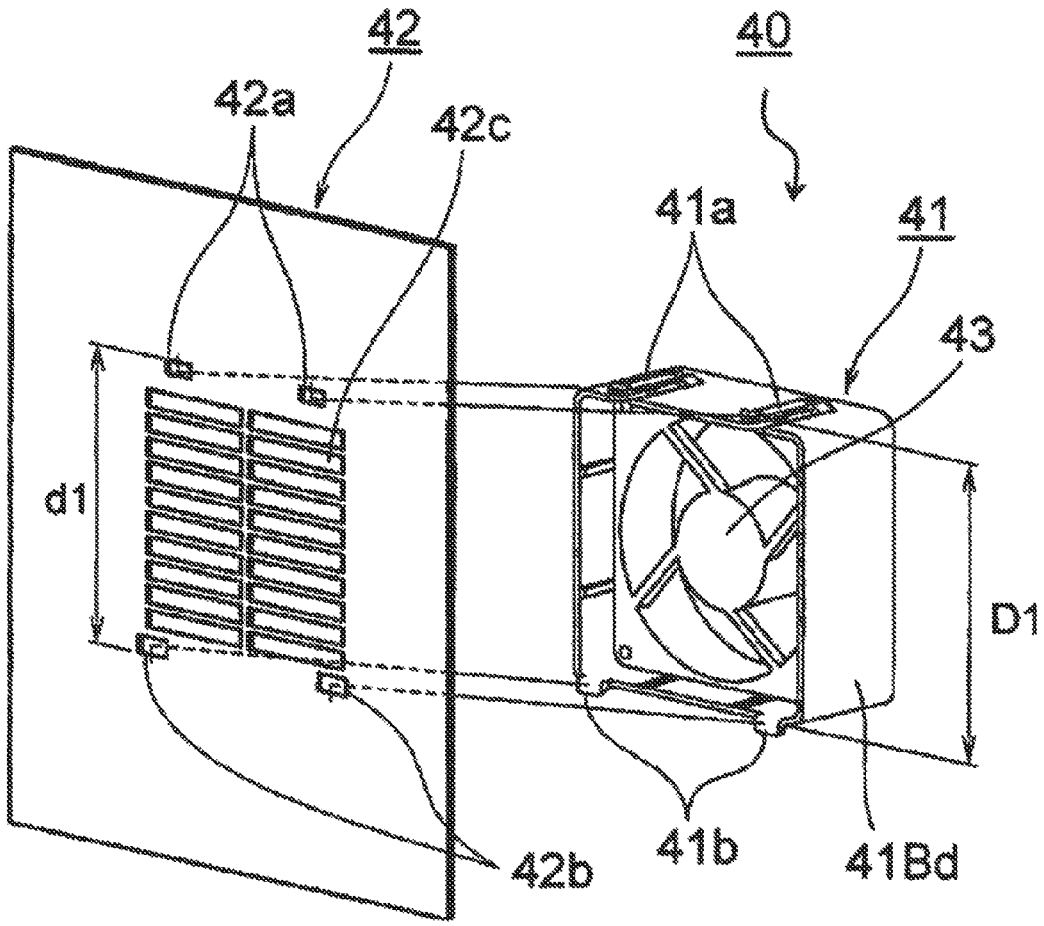
FIG. 3 is an exploded perspective view of the first embodiment, illustrating a state before the fan unit is attached.
Figure 4:
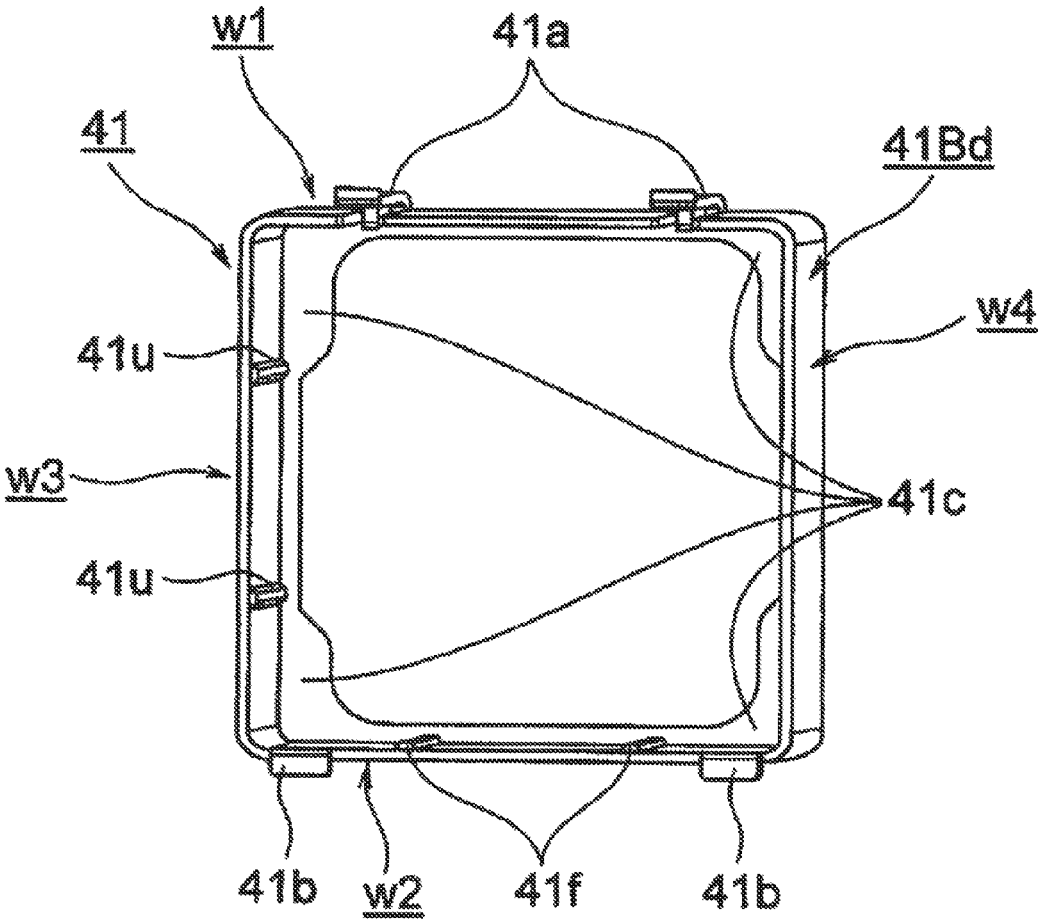
FIG. 4 is a perspective view of a fan holder according to the first embodiment of the invention.
Figure 5:
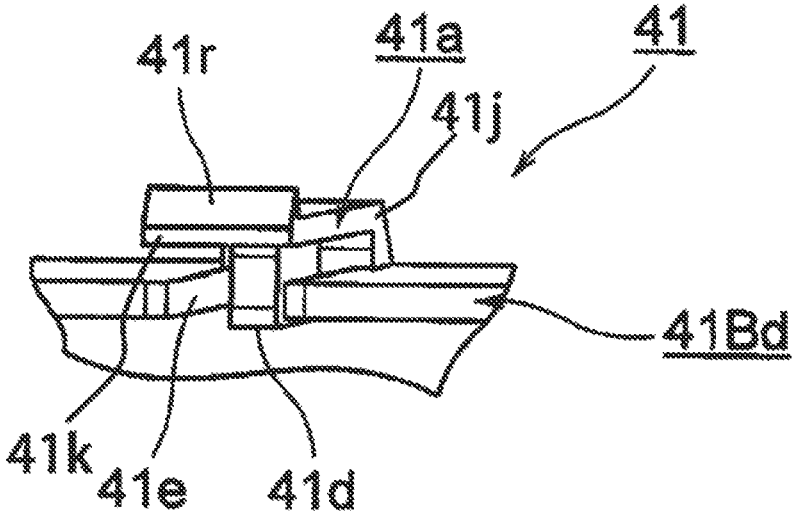
FIG. 5 is a perspective view of a part of the fan holder according to the first embodiment of the invention.
Figure 6:
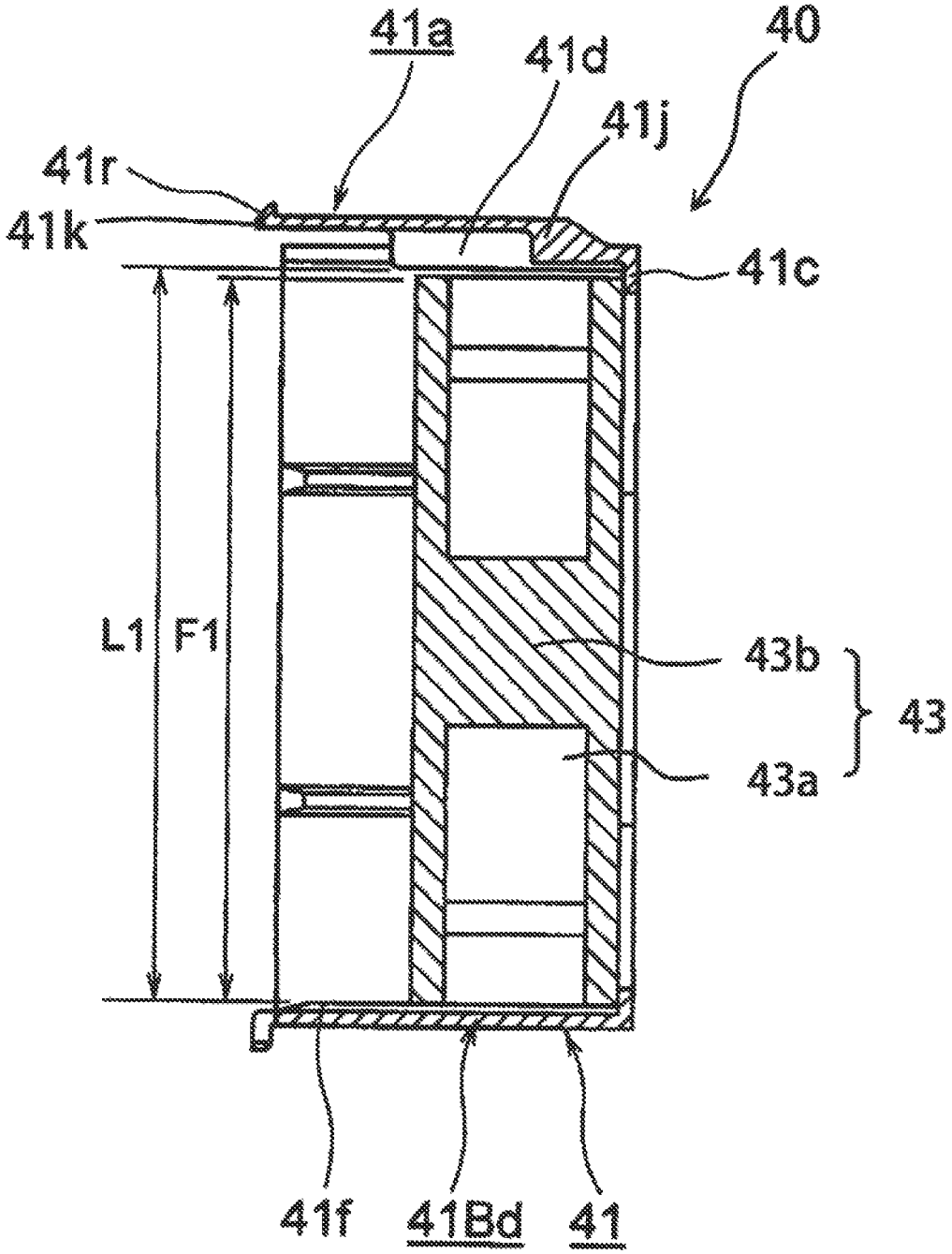
FIG. 6 is a sectional view of the fan unit according to the first embodiment of the invention.

FIG. 3 is an exploded perspective view of the rotor support mechanism of the first embodiment, illustrating a state where fan unit 40 is attached. FIG. 4 is a perspective view of fan holder 41 of the first embodiment. FIG. 5 is a perspective view of a part of fan holder 41 of the first embodiment. FIG. 6 is a sectional view of fan unit 40 of the first embodiment.

As shown in the figures, fan unit 40 includes: fan holder 41 serving as a support member; and ventilation fan 43, serving as an operable unit, to be supported by fan holder 41. A rotor support mechanism comprises: housing member 42, serving as a base, which is a part of housing 25 of image formation apparatus 10; and fan unit 40 to be attached to housing member 42. Fan 43 includes rotor 43*a* or a fan rotor and casing 43*b* rotatably supporting rotor 43*a*, as shown in FIG. 1.

Fan holder 41 is made of, for example, plastic which is flexibly deformable. Fan holder 41 includes: fan holder body 41 Bd, serving as a support member main body, configured to accommodate therein or loosely fit therein fan 43; claws 41*b* (or hooks), serving as a first engagement part or a positioning part, formed integrally with fan holder body 41 Bd; and latches 41*a*, each of which has claw 41*r* (or a hook) serving as a second engagement part, formed integrally with fan holder body 41Bd. Fan holder body 41Bd is formed in a tubular shape (a rectangular tubular shape in this embodiment) having an opening at a front end (that is, a housing member's side end) and an opening at a rear end (that is, an end on the opposite side). Fan holder body 41Bd is formed with wall part 41*c* (a rim or a flange) extending inwardly from the inner circumference of the rear opening end. Wall part 41*c*, serving as a positioning part or a stopper, is configured, when fan 43 is accommodated in fan holder body 41Bd, to be in contact with the rear end of fan 43, thereby positioning fan 43 in the axial direction.

In other words, fan holder body 41Bd includes: a tubular portion including top wall w1 serving as a first wall, bottom wall w2 serving as a second wall, side wall w3 serving as a third wall, and side wall w4 serving as a fourth wall; and wall part 41*c* (rim) formed at the inner circumference of the rear opening end of the tubular portion. Sections of wall part 41*c* (rim) that is in the vicinity of its four corners extend further inward than the other sections of wall part 41*c* (rim). Each latch 41*a* serves as an attachment part, being a flexible member, or a flexible arm. Latches 41*a* are formed at plural locations (two locations in the embodiment) of top wall w1 and each latch 41*a* has a long strip shape. Claws 41*b*, serving as the first engagement parts or the positioning parts, are formed at multiple locations (two locations in the embodiment) of bottom wall w2. Claws 41*b* are projected pieces extending slightly frontward from the front end of bottom wall w2 and then extending outwardly (downwardly) to a position lower than the bottom wall w2. The inner surface of bottom wall w2 has plural (two in the embodiment) ribs 41*f*, serving as a projection to be in contact with fan 43, extending from the rear end to the front end of bottom wall w2. The inner surface of each of side walls w3 and w4 has plural (two in the embodiment) ribs 41*u*, serving as projections to position fan 43 in the horizontal direction, extending from the rear end to the front end thereof. Note that in FIG. 4, ribs 41*u* of side wall w3 can be seen whereas ribs 41*u* of side wall w4 cannot be seen.

Latch 41*a* includes a flexible arm extending from the fan holder body 41Bd, whose rear end 41*j* (a fixed end or a base end) is connected to and supported by fan holder body 41Bd, and whose front end 41*k* (a free end or a fore-end) can be freely movable as latch 41*a* flexibly deforms. Front end (free end) 41*k* of latch 41*a* is located further frontward than the front end of fan holder body 41Bd and has a hook-shaped or triangle-shaped claw 41*r*, serving as the second engagement part, which is upwardly projected.

Fan holder body 41Bd has slits 41*e* at locations right below latches 41*a*. Each slit 91*e* extends from the rear end of a respective latch 41*a* to the front end of fan holder body 41Bd and has a width slightly wider than that of the respective latch 41*a*.

Latch 41*a* is located slightly above top wall w1 of fan holder body 41Bd in the state where no external force is applied to latch 41*a*. On the other hand, in the state where latch 41*a* is deformed downwardly by an external force, the front half of latch 41*a* can be located in slit 41*e* of top wall w1 and claw 41*r* of latch 41*a* can be located below the top surface of fan holder body 41Bd.

The lower surface (or the inner surface) of latch 41*a* has rib-like projection 41*d* serving as a press part. Rib-like projection 41*d* is projected downwardly from the lower surface and extends from the rear end to the middle section of latch 41*a* such that a part of projection 41*d* is located in slit 41*e*. Projection 41*d* is to be in contact with fan 43 when latch 41*a* is deformed downwardly in the state where fan 43 is accommodated in fan holder body 41Bd.

Housing member 42 has a predetermined shape, for example, a rectangle shape in the embodiment. The center section of housing member 42 is formed with opening 42*c*, or a ventilation hole, to discharge air from inside image formation apparatus 10 to outside image formation apparatus 10.

To attach fan holder 41 to housing member 42, housing member 42 includes: attachment holes 42*a*, serving as a second hole or a counterpart of the second engagement part, at locations corresponding to claws 41*r* (the second engagement parts) of latches 41*a* of fan holder 41; and attachment holes 42*b*, serving as a first hole or a counterpart of the first engagement part, at locations corresponding to claws 41*b* (the first engagement part) of fan holder 41.

The above-description satisfies the expression of "D1>d1", where d1 is defined as a distance between an upper end of the inner circumference of attachment hole 42*a* and a lower end of the inner circumference of attachment hole 42*b*, and D1 is defined as a distance between the upper end of latch 41*a* (that is, the upper end of claw 41*r*) and the lower surface of bottom wall w2 in the state where fan holder 41 is not attached to housing member 42.

The above-description also satisfies the expression of "L1>F1", where L1 is defined as the distance between the lower end of projection 41*d* and the upper end of ribs 41*f* in the state where fan holder 41 is not attached to housing member 42, and F1 is defined as the distance between the upper end of fan 43 and the lower end of fan 43 (that is, the upper ends of the ribs 41*f*). Note that in the state where fan holder 41 is not attached to housing member 42, projection 41*d* of latch 41*a* and fan 43 are spaced away and thus are not in contact with each other.

Next, the state where fan holder 41 is attached to housing member 42 will be described.

FIG. 1 is a sectional view of the rotor support mechanism of the first embodiment, illustrating the state where fan unit 40 is attached.

To attach fan holder 41 to housing member 42, first, fan 43 is inserted into fan holder body 41Bd until fan 43 is pressed against wall part 41*c* of fan holder body 41Bd. Thereby, fan 43 is accommodated in fan holder body 41Bd and is positioned in the axial direction with respect to fan holder body 41Bd.

Next, claws 41*b*of fan holder 41 are inserted in attachment holes 42*b* of housing member 42, thereby making claws 41*b* engaged with housing member 42. Then, latches 41*a* are inserted into attachment holes 42*a* as latches 41*a* are deformed, thereby making claw 41*r* engaged with housing member 42. In this state, latches 41*a* keep being deformed since distance d1 is less than distance D1.

Upon the deformation of each latch 41*a*, projection 41*d* of latch 41*a* moves downward such that projection 41*d* becomes inclined. Thus, distances L1' and F1 satisfy the expression of "L1'<F1", where L1' is defined as the shortest distance between the upper ends of ribs 41*f* and the lowest point of projection 41*d* in the state where the holder 41 is attached to housing member 42.

Therefore, rib-like projection 41*d* of each latch 41*a* pushes fan 43 against bottom wall w2, while fan 43 receives a reaction force from ribs 41*f* of bottom wall w2 toward rib-like projection 41*d* of latch 41*a*. That is, rib-like projection 41*d* of latch 41*a* and ribs 41*f* of bottom wall w2 sandwiches fan 43 therebetween, which positions fan 43 with respect to fan holder 41 in the vertical direction. In this way, fan 43 is held by fan holder 41, as being positioned between projection 41*d* and ribs 41*f*.

Since projection 41*d* of latch 41*a* is inclined at a certain angle with respect to the upper surface of fan 43 in the state where fan holder 41 is attached to housing member 42, the press force of projection 41*d* of latch 41*a* against the upper end of fan 43 is applied in the vertical direction and in the horizontal direction. The horizontal component of the press force presses fan 43 against wall part 41*c*, while the vertical component of the press force presses fan 43 against rib 41*f* of bottom wall w2. Therefore, fan 43 is securely held by fan holder 41, preventing rattling of fan 43 against fan holder 41. Also, since the deformation of latch 41*a* creates the horizontal component of the press force from projection 41*d* of latch 41*a*, fan holder 41 does not need to have an inclined surface or a tapper to produce such a horizontal component to push fan 43 in the horizontal direction. This simplifies the structure of a die to mold fan holder 41.

Note that, in the embodiment, the sizes of projections 41*d* and ribs 41*f* are designed such that latches 41*a* can be further deformed more than their deformation in the state where fan 43 is positioned with respect to fan holder 41 in the vertical direction.

As described above, according to the first embodiment, the attachment of fan 43 to fan holder 41 and the attachment of fan holder 41 to housing member 42 are easily completed only by inserting fan 43 into fan holder body 41Bd and then attaching fan holder 41 to housing member 42 with deformed latches 41*a*. That is, this simplifies the operation of attaching and detaching fan 43 to and from housing 25 of image formation apparatus 10, when fan 43 needs to be replaced.

Further, according to the first embodiment, the embodiment does not require fixing elements such as a screw to attach fan 43 to fan holder 41 and to attach fan holder 41 to housing member 42. This simplifies the structure of fan unit 40 and reduces the manufacturing cost of fan unit 40.

Although, in the first embodiment, projection 41*d* of each latch 41*a* presses the upper end of fan 43 when each latch 41*a* is deformed, a modification of the embodiment may have, instead of latches 41*a*, a deformable contact part such that the contact part and ribs 41*f* can hold fan 43.

Although the first embodiment uses fan holder 41 serving as the support member, a modification of the embodiment may use, instead of fan holder 41, a duct, serving as a support member, to guide the air flow generated by fan 43.

[Second Embodiment]

Next, the second embodiment of the invention will be

Next, the second embodiment of the invention will be described. Note that elements having the same configurations as those of the first embodiment are denoted by the same reference numbers and the effects achieved by the same configuration are omitted.

Figure 7:
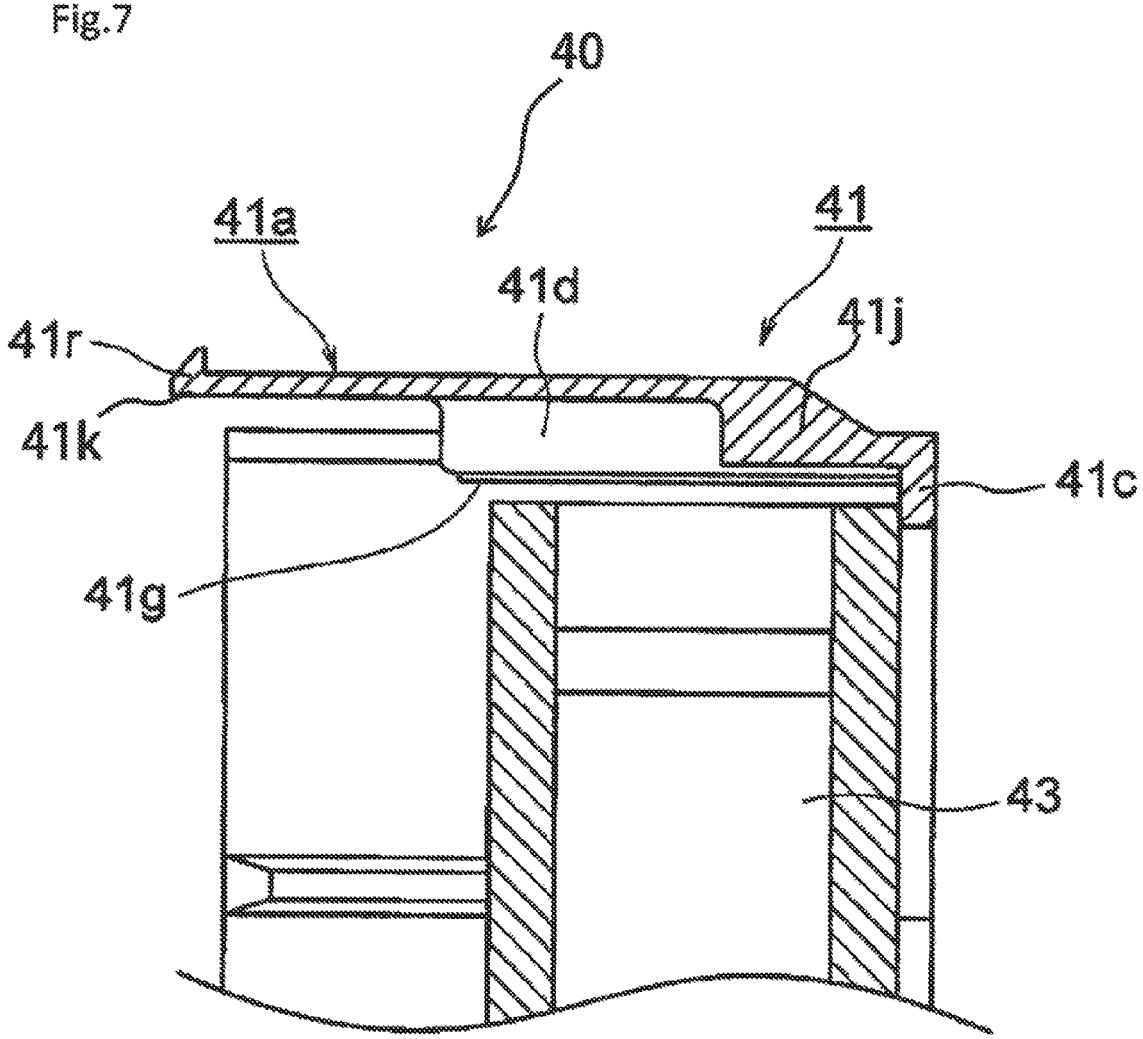
FIG. 7 is a sectional view illustrating a part of a fan unit according to a second embodiment of the invention.

FIG. 7 is a sectional view illustrating a part of fan unit 40 according to the second embodiment.

The second embodiment includes foam member 41*g*, serving as an elastic member or a cushioning member, covering the lower surface of projection 41*d*. Thus, in the state where fan 43 is sandwiched between projections 41*d* and ribs 41*f* (see, FIG. 1), foam member 41*g* is slightly deformed to produce a bias force. This improves the prevention of rattling of fan 43 against fan holder 41.

[Third Embodiment]

Next, the third embodiment of the invention will be described. Note that elements having the same configurations as those of the first and second embodiments are denoted by the same reference numbers and the effects achieved by the same configuration are omitted.

Figure 8:
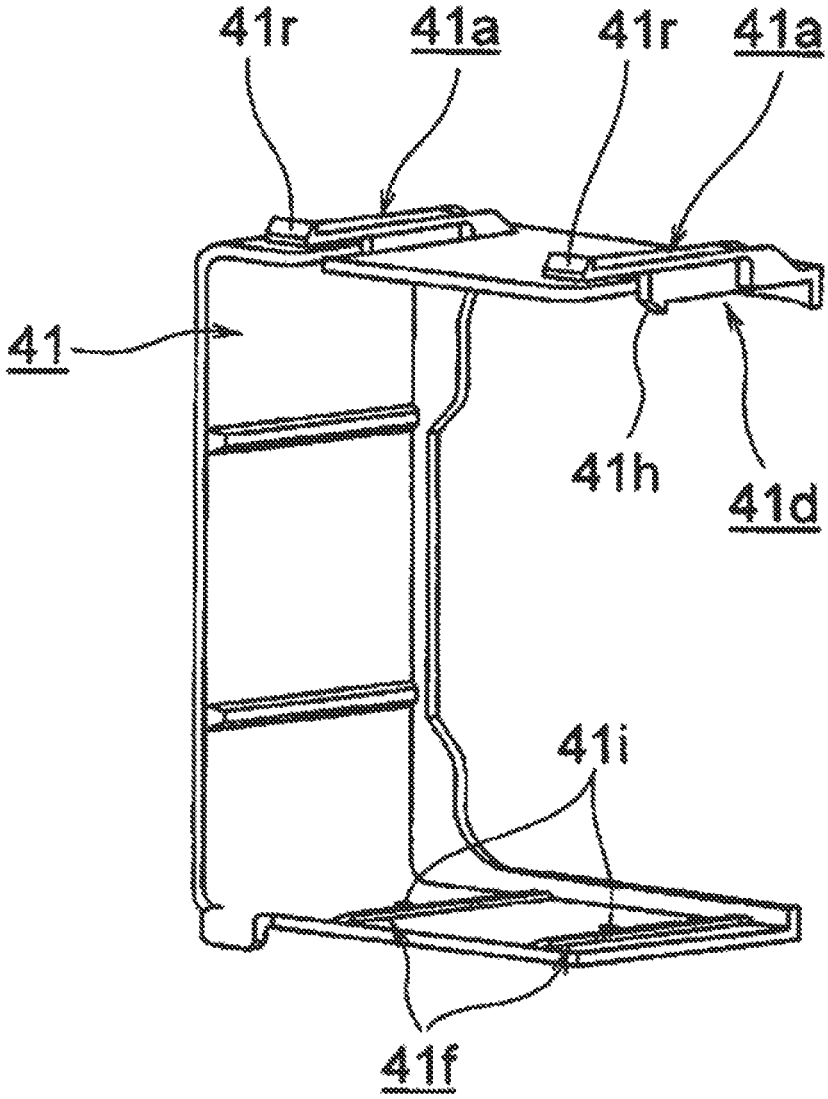
FIG. 8 is a perspective view illustrating a part of a fan holder according to a third embodiment of the invention.
Figure 9:
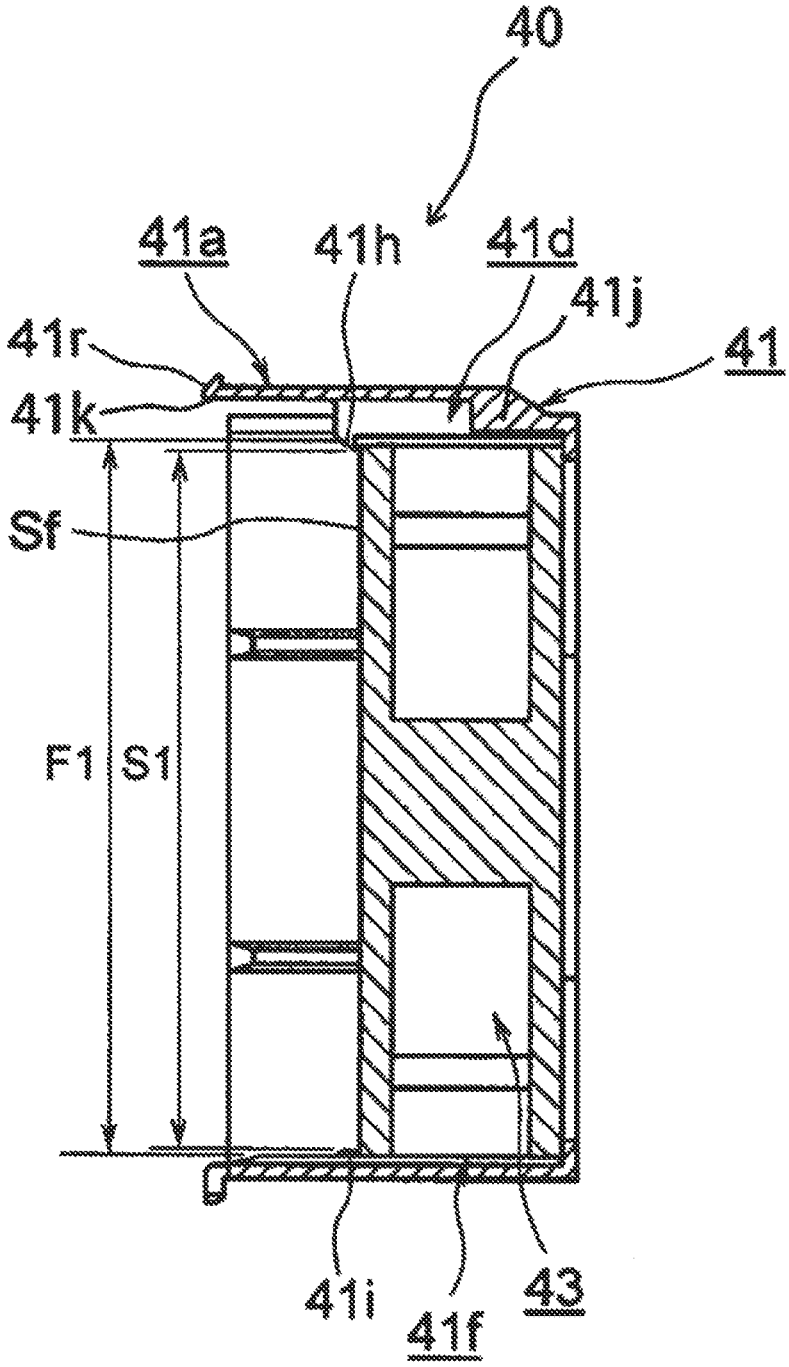
FIG. 9 is a sectional view of a fan unit according to the third embodiment of the invention.

FIG. 8 is a perspective view illustrating a part of fan holder 41 according to the third embodiment. FIG. 9 is a sectional view of fan unit 40 according to the third embodiment.

In the third embodiment, stopper 41*h*, serving as a first lock part, is projected downwardly from the front end of projection 41*d*, and stopper 41*i*, serving as a second lock part, is projected upwardly from rib 41*f* of bottom wall w2 at a position opposed to stopper 41*h*.

This described structure satisfies the expression of "S1 <F1", where S1 is defined as the distance between the upper end of stopper 41*h* and the lower end of stopper 41*i*, and F1 is defined as the distance between the upper end and the lower end of fan 43 in the state where fan holder 41 is not attached to housing member 42. The difference between distances F1 and S1 is approximately 1 [mm].

Note that the positions of stoppers 41*h* and 41*i* are designed such that front face Sf of fan 43 is not in contact with the rear ends of stoppers 41*h* and 41*i* in the state where fan 43 in fan holder 41 is in contact with wall part 41*c* (see, FIG. 1).

Like the first embodiment, the described structure satisfies the expression of "L1>F1", where L1 is defined as the distance between the lower end of projection 41*d* and the upper end of ribs 41*f* in the state where fan holder 41 is not attached to housing member 42, and F1 is defined as the distance between the upper end of fan 43 and the lower end of fan 43 (that is, the upper ends of the ribs 41*f*).

Next, the state where fan holder 41 is attached to housing member 42 will be described.

Figure 10:
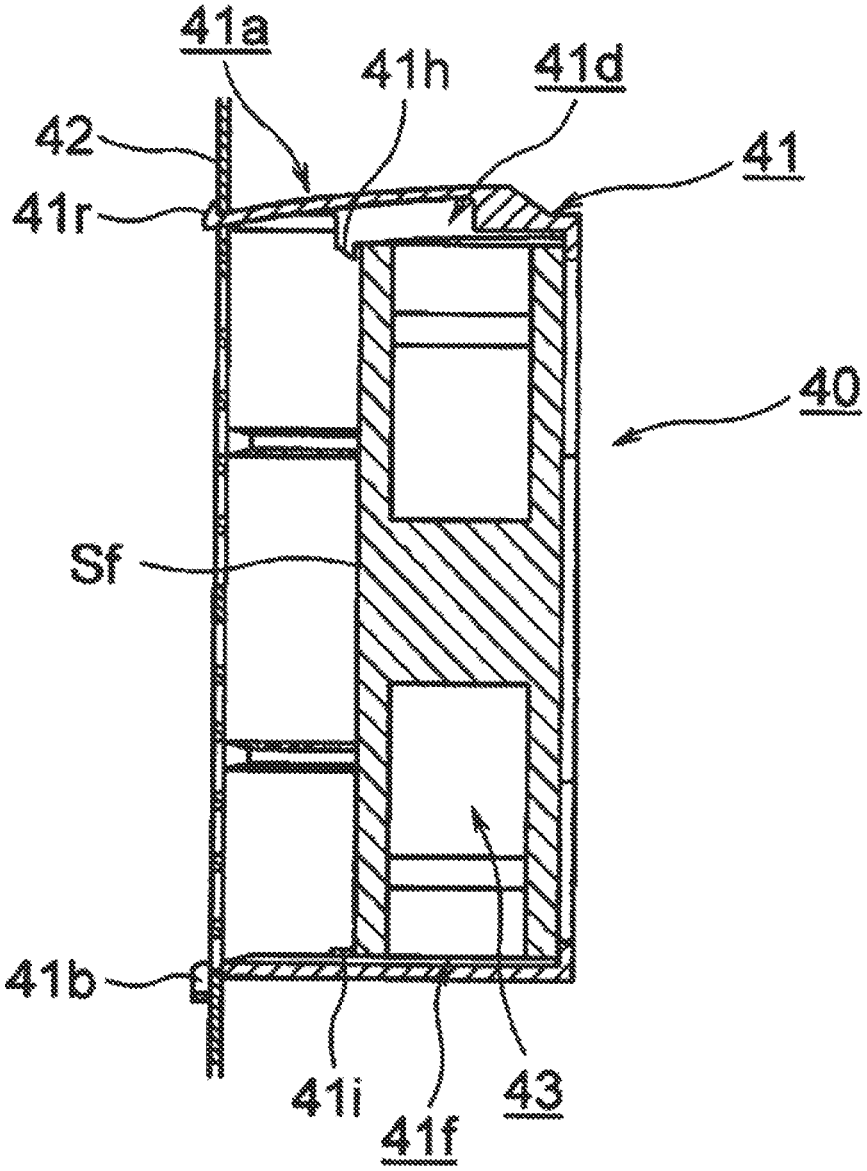
FIG. 10 is a sectional view of a rotor support mechanism according to the third embodiment of the invention, illustrating a state where the fan unit is attached.
Figure 11:
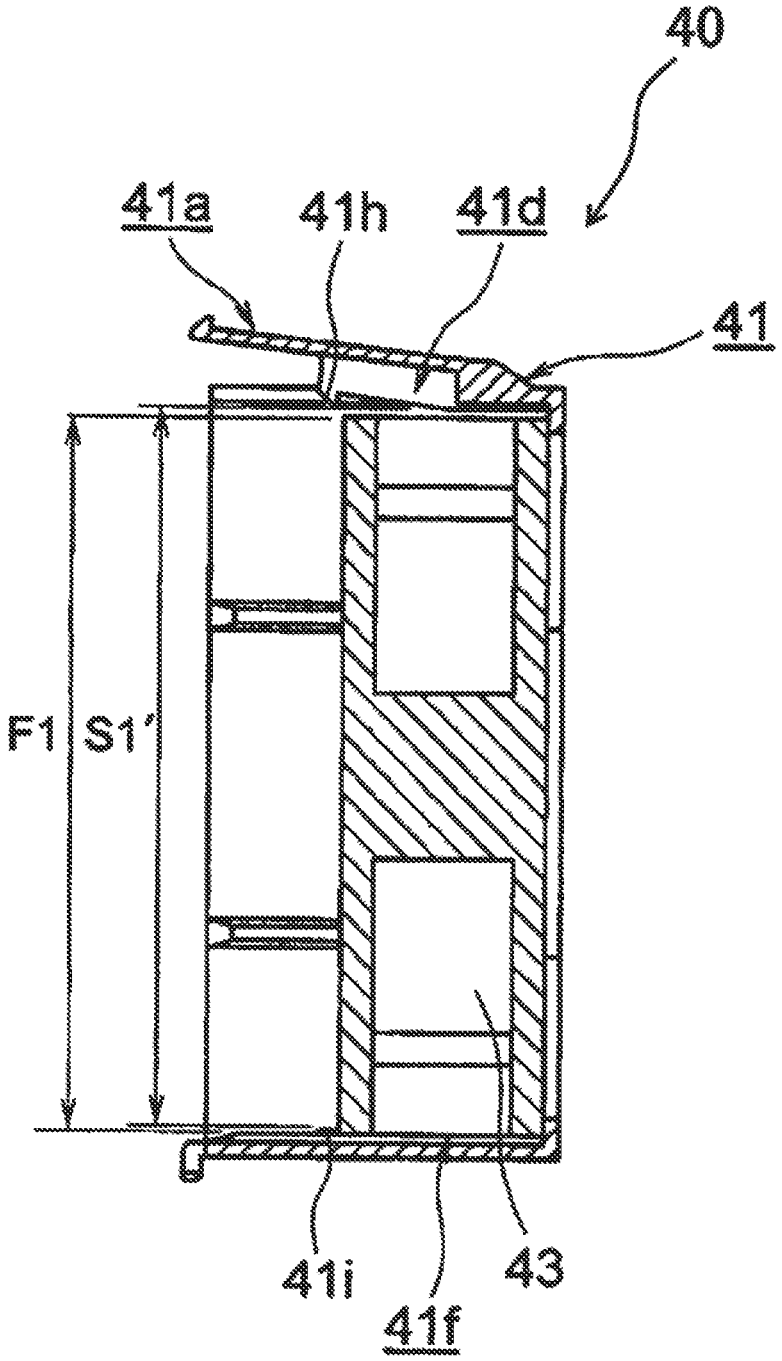
FIG. 11 is a view for explaining a method of attaching and detaching a fan to and from a fan holder according to the third embodiment of the invention.

FIG. 10 is a sectional view of the rotor support mechanism according to the third embodiment, illustrating the state where fan unit 40 is attached. FIG. 11 is a view for explaining the method of attaching and detaching fan 43 to and from fan holder 41 according to the third embodiment.

In the third embodiment, to attach fan holder 41 to housing member 42, first, fan 43 is inserted into fan holder 41 until fan 43 is stopped by wall part 41*c*. Thereby, fan 43 is accommodated in fan holder 41 and positioned in the axial direction with respect to fan holder 41.

Next, claws 41*b*, serving as the first engagement parts, of fan holder 41 are inserted into attachment holes 42*b* of housing member 42, serving as the first holes or the counterparts of the first engagement parts, so that claws 41*b* are engaged with housing member 42. Next, claws 41*r*, serving as the second engagement parts, of latches 41*a* are inserted into attachment holes 42*a*, serving as the second holes or the counterparts of the second engagement parts, as latches 41*a* are deformed. Thereby, claws 41*r* are engaged with housing member 42. In this state, since distance d1 is shorter than distance D1 , latches 41*a* keep being deformed.

When latches 41*a* are deformed, projections 41*d* of latches 41*a* move downward such that projections 41*d* become inclined. Thus, like the first embodiment, projections 41*d* of latches 41*a* push fan 43 toward bottom wall w2, and fan 43 receives a reaction force from ribs 41*f* of bottom wall w2 toward projections 41*d* of latches 41*a*. That is, fan 43 is positioned between projections 41*d* of latches 41*a* and ribs 41*f* of bottom wall w2, thereby holding fan 43 in fan holder 41 while positioning fan 43 with respect to fan holder 41 in the vertical direction. In this state, since projections 41*d* of latches 91*a* are inclined at a certain angle with respect to the upper surface of fan 43, the press force from projections 41*d* against the upper surface of fan 43 includes a vertical component and a horizontal component. The horizontal component of the press force presses fan 43 toward wall part 41*c*, thereby front face Sf of fan 43 is spaced away from, and not in contact with, the rear ends of stoppers 41*h* and 41*i*.

Note that, upon inserting (attaching) fan 43 to fan holder 41 or upon ejecting (detaching) fan 43 from fan holder 41, latches 41*a* are made to be flexibly deformed in the upward direction (the direction away from fan 43) until distance S1' between the lower end of stopper 41*h* and the upper end of stopper 41*i* is greater than distance F1 between the upper end and the lower end of fan 43 (S1' >F1), as shown in FIG. 11. Therefore, by flexibly deforming latches 41*a*, fan 43 can be easily attached and detached to and from fan holder 41.

As described above, the third embodiment has stopper 41*h* formed at projections 41*d* and stopper 41*i* formed at ribs 41*f* such that distance S1' between the lower end of stopper 41*h* and the upper end of stopper 41*i* is shorter than distance F1 between the upper end and the lower end of fan 43. This structure prevents fan 43 from falling off from fan holder 41 after fan 43 is inserted in fan holder 41.

[Fourth Embodiment]

Next, the fourth embodiment of the invention will be described. Note that elements having the same configurations as those of the first to third embodiments are denoted by the same reference numbers and the effects achieved by the same configuration are omitted.

Figure 12:
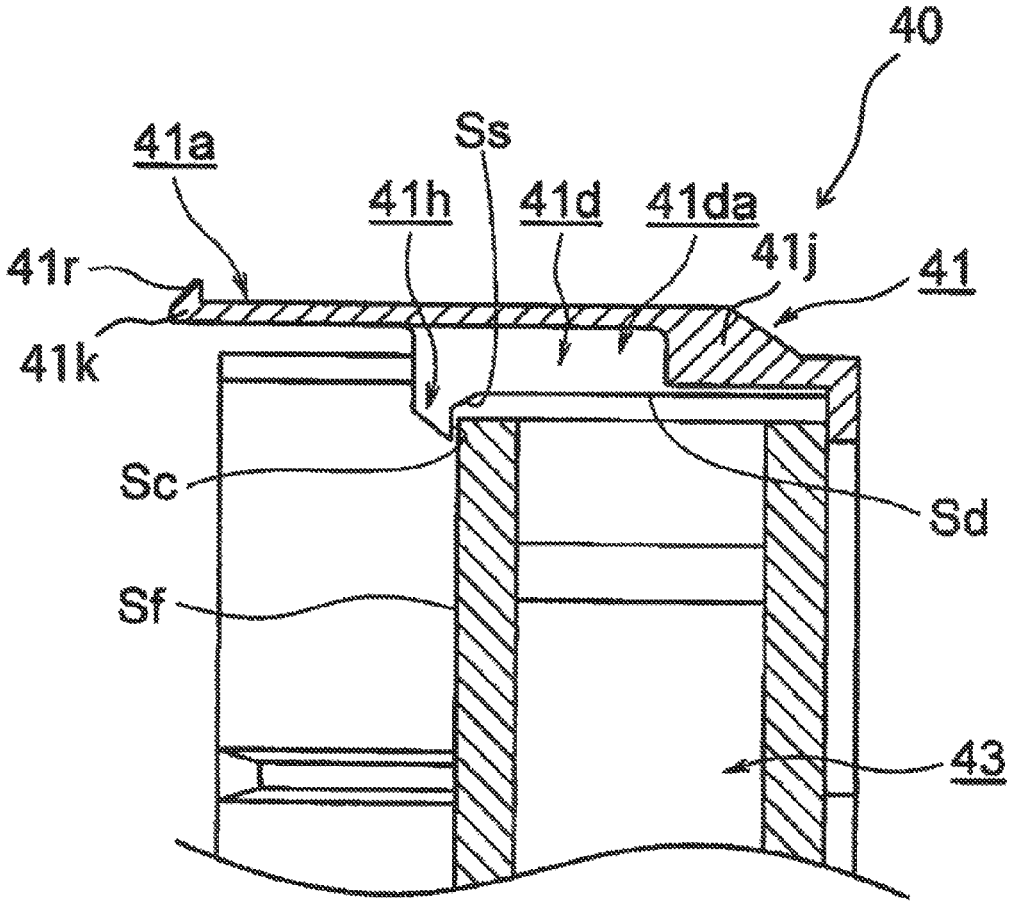
FIG. 12 is a sectional view of a part of a fan unit according to a fourth embodiment of the invention.
Figure 13:
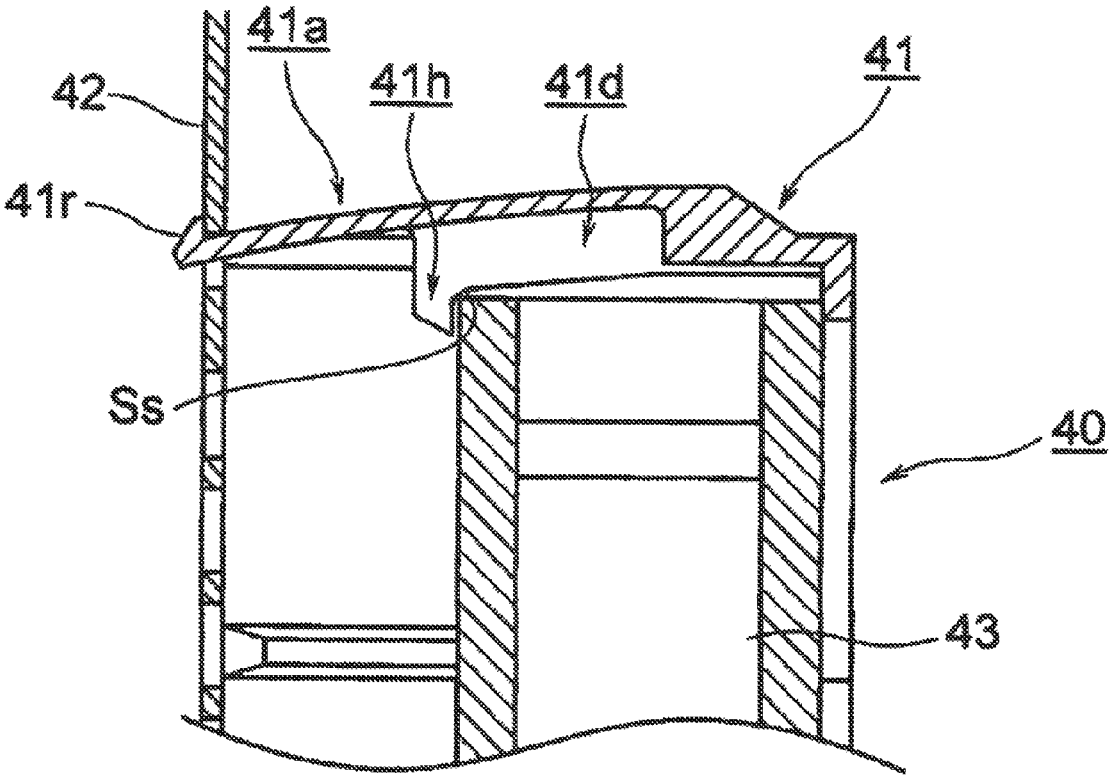
FIG. 13 is a sectional view of a part of a rotor support mechanism according to the fourth embodiment of the invention, illustrating a state where the fan unit is attached.
Figure 14:
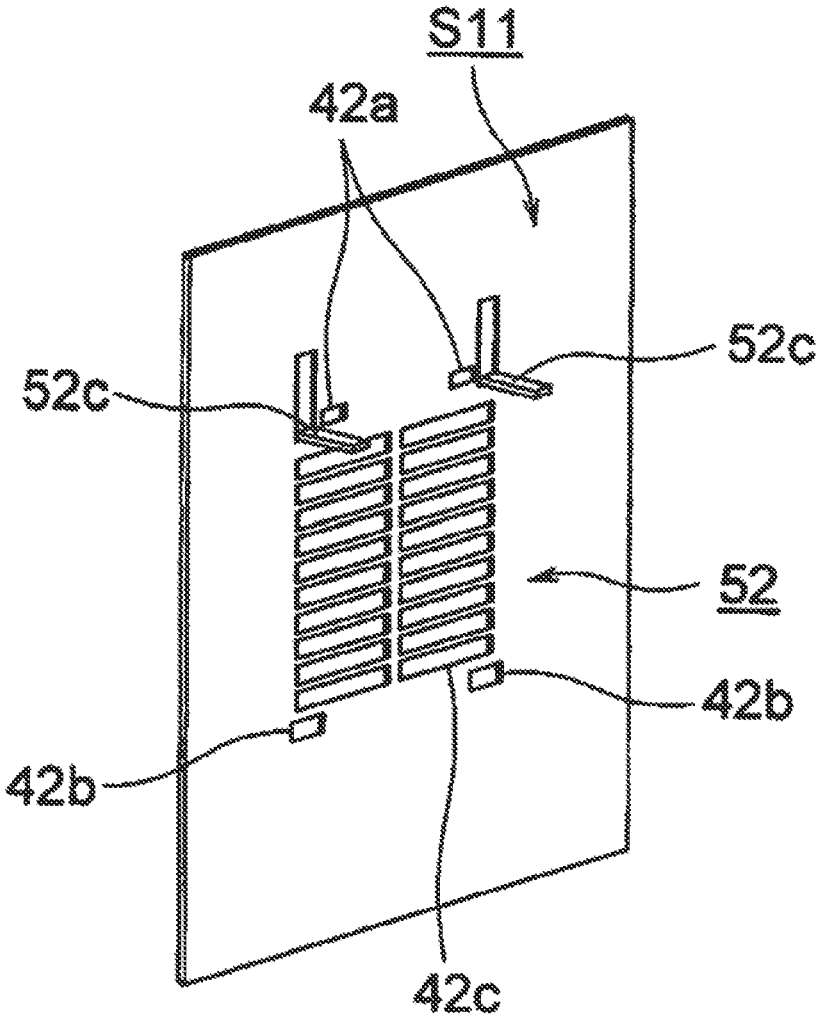
FIG. 14 is a perspective view illustrating a part of a housing member according to a fifth embodiment of the invention.

FIG. 12 is a sectional view of a part of fan unit 40 according to the fourth embodiment. FIG. 13 is a sectional view of a part of the rotor support mechanism of the fourth embodiment, illustrating a state where fan unit 40 is attached.

The difference between the third embodiment and the fourth embodiment is that, in the fourth embodiment, projection 41*d* is formed with inclined surface Ss at the base portion of the stopper 41*h*. Inclined surface Ss is formed at the corner between lower surface Sd of main body 41*da* of projection 41*d* and vertical surface Sc of stopper 41*h*, which is to be opposed to front surface Sf of fan 43, such that inclined surface Ss is inclined with respect to lower surface Sd and vertical surface Sc and connects lower surface Sd and vertical surface Sc.

When fan unit 40 is attached to housing member 42 by inserting claws 41*b* of fan holder 41 in attachment holes 42*b* of housing member 42 and inserting claws 41*r* of latches 41*a* into attachment holes 42*a* of housing member 42, as latches 41*a* deform, fan 43 is positioned between projections 41*d* of latches 41*a* and ribs 41*f* of bottom wall w2 (see, FIG. 1), whereby fan 43 is held by fan holder 41. In this state, inclined surface Ss of each projection 41*d* is in press contact with the upper end of fan 43 in the fourth embodiment, whereas lower surface Sd of each projection 41*d* is in press contact with the upper end of fan 43 as in the first embodiment. An angle between inclined surface Ss of projection 41*d* and the upper end of fan 43 when inclined surface Ss is in press contact with the upper end of fan 43 is greater than an angle between lower surface Sd of projection 41*d* and the upper end of fan 43 in the first embodiment. Thus, the fourth embodiment has a larger horizontal component of the press force from projection 41*d* (inclined surface Ss) against fan 43 than the first embodiment. That is, fan 43 is pressed against wall part 41*c* serving as the stopper with a larger force, thereby fan 43 is more securely held in fan holder 41.

[Fifth embodiment]

Figure 15:
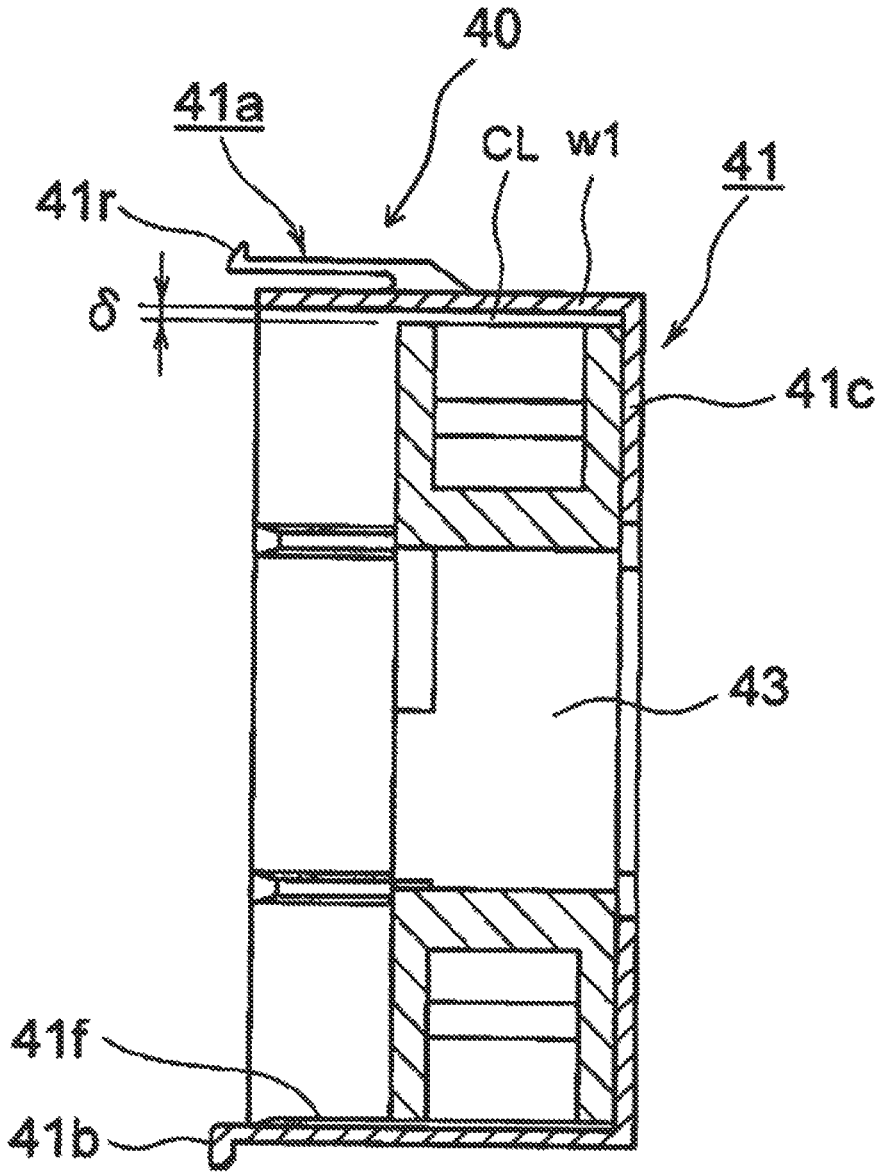
FIG. 15 is a sectional view illustrating a fan unit according to the fifth embodiment of the invention.

Next, the fifth embodiment of the invention will be described. Note that elements having the same configurations as those of the first to fourth embodiments are denoted by the same reference numbers and the effects achieved by the same configuration are omitted. housing member 52 of the fifth embodiment. FIG. 15 is a sectional view illustrating fan unit 40 of the fifth embodiment.

The difference between the fifth embodiment and the first embodiment is that in the fifth embodiment, fan holder 41 does not include projections 41*d* serving as the press parts whereas housing member 52, serving as a base or an attachment base, which is a part of housing 25 of image formation apparatus 10 (see, FIG. 2), includes projections 52*c* serving as press parts. Plural (two in the embodiment) projections 52*c*, which serve as flexible members, are projected from inside surface S1 of housing member 52 (an inside surface of housing 25) at a position lower than attachment hole 42*a* (in the vicinity of attachment hole 42*a*) and extend toward fan holder 41. Each projection 52*c* is a flat-plate and may be formed by cutting a part of housing member 52 to make a long strip piece and bending the strip piece. When fan unit 40 is attached to housing member 52, projections 52*c* are pressed into gap CL between fan 43 and top wall w1 of fan holder 41 (see, FIG. 16).

Where the thickness of gap CL between fan 43 and top wall w1 of fan holder 41 is defined as "δ" and the thickness of projection 52*c* is defined as "h", the expression of "$1.2*\delta \leq h \leq 1.5*\delta$" is satisfied.

The fore-end of each projection 52*c* is formed with an unillustrated chamfered face, serving as an insertion guide, to facilitate the press-insertion of projections 52*c* into gap CL.

Figure 16:
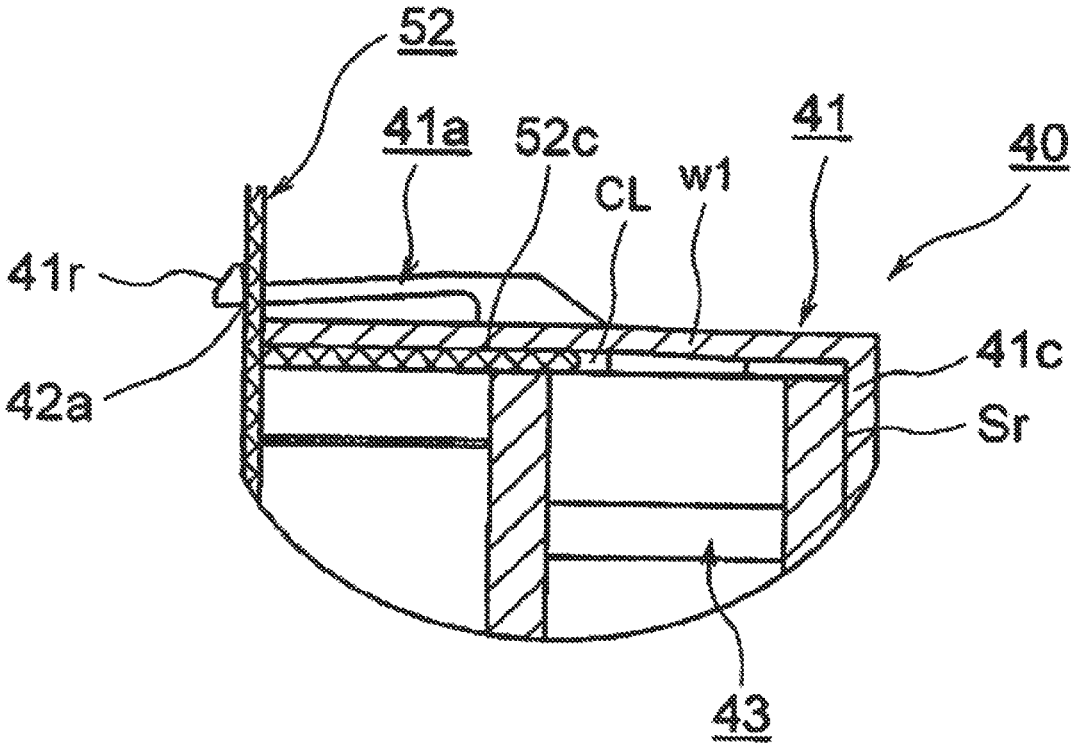
FIG. 16 is a sectional view of a part of a rotor support mechanism according to the fifth embodiment of the invention, illustrating a state where the fan unit is attached.

FIG. 16 is a sectional view of a part of the rotor support mechanism of the fifth embodiment, illustrating the state where fan unit 40 is attached.

In the fifth embodiment, to attach fan 43 to housing member

In the fifth embodiment, to attach fan 43 to housing member 52, first, fan 43 is inserted in fan holder 41 until fan 43 is pressed against wall part 41*c*. Thereby, fan unit 40 is assembled wherein fan 43 accommodated in fan holder 41 is positioned with respect to fan holder 41 in the axial direction.

Next, claws 41*b* of bottom wall w2 of fan holder 41 are inserted into attachment holes 92*b* of housing member 42, and thereby claws 41*b* of fan holder 91 are engaged with housing member 52. Then, claws 41*r* of latches 41*a* are inserted into attachment holes 42*a* as latches 41*a* are elastically deformed, and thereby claws 41*r* of fan holder 41 are engaged with housing member 52. In this state, since distance d1 is less than distance D1, latches 41*a* stay being deformed.

When fan unit 40 is attached to housing member 52, projections 52*c* of housing member 52 are press-inserted into gap CL between top wall w1 of fan holder 41 and the upper surface of fan 43. This press-insertion of projections 52*c* into gap CL presses fan 43 toward bottom wall w2 (see, FIG. 4) of fan holder 41, as a reaction force from ribs 41*f* of bottom wall w2 presses fan 43 against top wall w1 of fan holder 41 via projections 52*c* of housing member 52. Note that since fan holder 41 is formed of plastic, resin, or the like, which have elasticity, top wall w1 of fan holder 41 is deformed upon the press-insertion of projections 52*c* into gap CL.

According to the fifth embodiment, as described above, upon the attachment of fan holder 41 to housing member 52, projections 52*c* of housing member 52 are inserted into gap CL between fan holder 41 and the fan 43. With this, fan 43 is pressed between bottom wall w2 and top wall w1 with projections 52*c* of housing member 52, and is pressed against wall part 41*c*, thereby preventing rattling of fan 43 against fan holder 41.

Further, according to the fifth embodiment, rattling of fan 43 against fan holder 41 and rattling of fan holder 41 against housing member 52 are prevented with a smaller deformation of latches 41*a* than that of the first to fourth embodiment. Therefore, an excessive deformation of latches 41*a* due to variations of components 43, 41, and 52 in size is prevented. This suppresses deterioration of latches 41*a*.

Although thickness h of each projection 52*c* is constant from the fore-end to the base end of each projection 52*c* in the fifth embodiment, projections 52*c* may have a wedge shape wherein thickness h of each projection 52*c* gradually increases from the fore-end to the base end of projection 52*c*.

Although projections 52*c* are formed integrally with the main body of housing member 52 in the fifth embodiment, projections 52*c* may be made of a separate member from the main body of housing member 52 and be connected to the main body of housing member 52.

A printer has been described as an image forming apparatus in the above embodiments. However, those embodiments can be employed to a copy machine, a facsimile machine, a multi-functional peripheral/printer, and the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A rotor support mechanism comprising:

an operable unit including a rotor and a casing rotatably supporting the rotor; and a support member configured to be attached to a base and including a support member main body configured to accommodate the operable unit therein at an accommodation position, an insertion opening through which the operable unit is inserted into the support member main body, a stopper configured to stop the operable unit at the accommodation position in a direction of inserting the operable unit into the support member main body, and a flexible member formed with a press part, the flexible member configured to deform toward an inside of the support member main body during attachment of the support member to the base, such that the flexible member is deformed toward the inside of the support member main body when the flexible member is engaged with the base, and such that the flexible member is not deformed when the flexible member is not engaged with the base, wherein, in a state in which the flexible member is engaged with the base and is deformed toward the inside of the support member main body, the press part presses the operable unit against the stopper in the direction of inserting and against a part of the support member main body in a direction substantially orthogonal to the direction of inserting, to thereby hold the operable unit in the support member main body.

2. The rotor support mechanism according to claim 1, wherein the flexible member includes a base end connected to the support member main body and a fore-end formed with an engagement part configured to be engaged with the base.

3. The rotor support mechanism according to claim 1, wherein the flexible member includes a base end connected to the support member main body and a fore-end formed with an engagement part configured to be engaged with the base, and the flexible member is formed with the press part between the base end and the fore-end of the flexible member.

4. The rotor support mechanism according to claim 1, wherein the press part is configured, when the support member having the operable unit accommodated therein is attached to the base, to press the operable unit against the stopper in the direction of inserting and against the part of the support member main body in the direction substantially orthogonal to the direction of inserting, to thereby hold the operable unit in the support member main body.

5. The rotor support mechanism according to claim 1, wherein the press part is configured, when the support member having the operable unit accommodated therein is attached to the base, to press the operable unit onto the stopper thereby sandwiching the operable unit between the press part and the stopper, and to press the operable unit to the part of the support member main body thereby sandwiching the operable unit between the press part and the part of the support member main body.

6. The rotor support mechanism according to claim 3, wherein the flexible member includes a first face, and a second face configured as a reverse side of the first face, wherein the engagement part is formed on the first face of the flexible member and the press part is formed on the second face of the flexible member.

7. The rotor support mechanism according to claim 1, wherein the flexible member includes a first face and a second face configured as a reverse side of the first face, wherein the first face comprises an engagement part configured to engage with the base, and the second face comprises the press part configured to be in contact with the operable unit when the support member with the operable unit accommodated in the support member main body is attached to the base.

8. The rotor support mechanism according to claim 1, wherein the flexible member extends in a direction opposite to the direction of inserting from a plane defined by an end of the operable unit opposite from the stopper.

9. The rotor support mechanism according to claim 8, wherein the flexible member is inclined at a non-right angle with respect to an upper face of the operable unit when the support member having the operable unit accommodated therein is attached to the base.

10. The rotor support mechanism according to claim 1, wherein the press part extends in a direction opposite to the direction of inserting from a plane defined by an end of the operable unit opposite from the stopper.

11. The rotor support mechanism according to claim 10, wherein the press part is inclined at a non-right angle with respect to an upper face of the operable unit when the support member having the operable unit accommodated therein is attached to the base.

12. The rotor support mechanism according to claim 1, wherein a shortest distance between the press part and the part of the support member main body opposite thereto is less than a width of the operable unit when the support member with the operable unit accommodated therein is attached to the base.

13. The rotor support mechanism according to claim 1, wherein a shortest distance between the press part and the part of the support member main body opposite thereto is greater than a width of the operable unit when the support member with the operable unit accommodated therein is not attached to the base.

14. The rotor support mechanism according to claim 1, wherein the press part includes a cushioning member integrally formed on the press part and disposed at a position facing the operable unit.

15. The rotor support mechanism according to claim 1, wherein the press part is formed with a lock part provided on an end portion of the press part and configured to prevent the operable unit accommodated in the support member main body from moving in a direction opposite to the direction of inserting of the operable unit into the support member main body.

16. The rotor support mechanism according to claim 15, wherein the press part is formed with an inclined surface at a base portion of the lock part.

17. An image formation apparatus comprising the rotor support mechanism according to claim 1.

18. A rotor support mechanism comprising:

an operable unit including a rotor and a casing rotatably supporting the rotor;

a support member including a support member main body configured to accommodate therein the operable unit at an accommodation position, an insertion opening through which the operable unit is inserted into the support member main body, a stopper configured to stop the operable unit at the accommodation position in a direction of inserting the operable unit into the support member main body, and an attachment part to attach the support member main body to a base; and a press part configured, when the support member having the operable unit accommodated therein is attached to the base, to press the operable unit against the stopper in the direction of inserting and against a part of the support member main body in a direction substantially orthogonal to the direction of inserting, to thereby hold the operable unit in the support member main body, wherein the press part is configured as a projection projected from the base, and the projection from the base is configured to be inserted in a gap between the support member main body and the operable unit, and wherein the attachment part attaches to the base by way of at least one attachment hole provided on a major surface of the base, the projection extending in a direction orthogonal to the major surface of the base.

19. The rotor support mechanism according to claim 18, wherein the operable unit is a fan.

20. The rotor support mechanism according to claim 18, wherein the support member is tubular-shaped.

21. An image formation apparatus comprising the rotor support mechanism according to claim 18.

22. The image formation apparatus according to claim 21, further comprising:

a housing comprising the base;

an image formation unit provided inside of the housing and configured to form a developer image;

an image transfer unit provided inside of the housing and configured to transfer the developer image to a medium; and a fixation unit provided inside of the housing and configured to fix the developer image to the medium by heating the medium having the developer image thereon.

* * * * *